US007150627B2

(12) United States Patent
Gaur et al.

(10) Patent No.: US 7,150,627 B2
(45) Date of Patent: Dec. 19, 2006

(54) TRANSPORTED MATERIAL HEATING WITH CONTROLLED ATMOSPHERE

(76) Inventors: Siddhartha Gaur, 7521 England Dr., Plano, TX (US) 75025; Vibha Bansal, 7521 England, Plano, TX (US) 75025

( * ) Notice: Subject to any disclaimer, the term of this patent is extended or adjusted under 35 U.S.C. 154(b) by 0 days.

(21) Appl. No.: 11/119,411

(22) Filed: Apr. 30, 2005

(65) Prior Publication Data

US 2006/0246391 A1 Nov. 2, 2006

(51) Int. Cl.
*F27B 9/10* (2006.01)

(52) U.S. Cl. ..... 432/144; 432/128

(58) Field of Classification Search ..... 432/121, 432/128, 137, 143, 144
See application file for complete search history.

(56) References Cited

U.S. PATENT DOCUMENTS 3,778,221 A * 12/1973 Bloom ..... 432/11
3,971,639 A 7/1976 Matthews
4,066,740 A 1/1978 Erickson
4,128,394 A 12/1978 Naito et al.
4,192,645 A 3/1980 Hassler
4,287,024 A 9/1981 Thompson
4,294,878 A 10/1981 Cunningham et al.
4,298,341 A 11/1981 Nowack
4,329,142 A * 5/1982 Dyer ..... 432/19
4,421,481 A * 12/1983 Holz et al. ..... 432/239
4,488,027 A 12/1984 Dudley et al.
4,653,732 A 3/1987 Wunning et al.
4,674,975 A * 6/1987 Corato et al. ..... 432/11
4,831,238 A 5/1989 Smith et al.
4,873,107 A 10/1989 Archer
4,965,435 A 10/1990 Smith et al.
5,090,651 A 2/1992 Mittag
5,114,542 A 5/1992 Childress et al.
5,287,383 A 2/1994 Hirai
5,678,496 A 10/1997 Buizza et al.
5,725,738 A 3/1998 Brioni et al.
5,906,485 A 5/1999 Groff et al.
6,015,288 A 1/2000 Mundon
6,089,860 A * 7/2000 Dull et al. ..... 432/72
6,283,748 B1 * 9/2001 Orbeck et al. ..... 432/126
6,383,449 B1 5/2002 Pennekamp et al.
6,572,369 B1 6/2003 Linke
6,773,256 B1 8/2004 Joshi et al.

* cited by examiner

*Primary Examiner*—Gregory Wilson
(74) *Attorney, Agent, or Firm*—Osha Liang LLP; John W. Montgomery

(57) ABSTRACT

A tunnel oven for heating transported carbonaceous materials includes an enclosure having a passage and a transport device for moving solid carbonaceous materials through and along a length of the passage. A direct convection heater is operably connected to the enclosure to heat the solid carbonaceous material as the material is moved along the length of the passage. A temperature controller is operably coupled to the heater to provide one or more selected temperatures along the length of the passage. An atmosphere controller controls the heating atmosphere along the length of the passage so that the surface of the solid carbonaceous material is protected against oxidation.

28 Claims, 3 Drawing Sheets

TRANSPORTED MATERIAL HEATING WITH CONTROLLED ATMOSPHERE

BACKGROUND OF INVENTION

1. Field of the Invention

The invention relates generally to an apparatus and method for heating transported materials and in particular to an apparatus and method for continuous heating of carbonaceous materials above the ignition temperature of the carbonaceous materials, such as tunnel kilns, conveyor ovens, or other continuous heating ovens.

2. Background Art

Prior devices for continuous heating or heating of moving materials to high temperatures above normal food cooking temperatures, such as tunnel kilns and conveyor ovens have been used primarily for non carbonaceous materials such as brake linings, tiles, and ceramics. Food cooking ovens typically avoid temperatures above the combustion flash point of any carbonaceous material in the foods to be heated. The use of high temperature tunnel kilns for heating carbonaceous materials has been generally limited to placing the target material in an enclosed casing or muffler that is moved through the oven with the carbonaceous material therein, so that the carbon materials were shielded from direct atmospheric convection heating of the oven. Such prior ovens therefore relied upon conductive heating through the layers of the muffler enclosure. Typically such muffler enclosure devices included a layer of another carbonaceous material such as coke breeze to protect the surface of the carbonaceous materials from oxidation. The entire muffler, coke breeze coating, and the carbonaceous material contained therein all moved together through the oven.

SUMMARY OF INVENTION

A tunnel oven for heating transported carbonaceous materials includes an enclosure having a passage and a transport device for moving solid carbonaceous materials through and along a length of the passage. A direct convection heater is operably connected to the enclosure to heat the solid carbonaceous material as the material is moved along the length of the passage. A temperature controller is operably coupled to the heater to provide one or more selected temperatures along the length of the passage. An atmosphere controller controls the heating atmosphere along the length of the passage so that the surface of the solid carbonaceous material is protected against oxidation.

Other aspects and advantages of the invention will be apparent from the following description and the appended claims.

DETAILED DESCRIPTION

Figure 1:
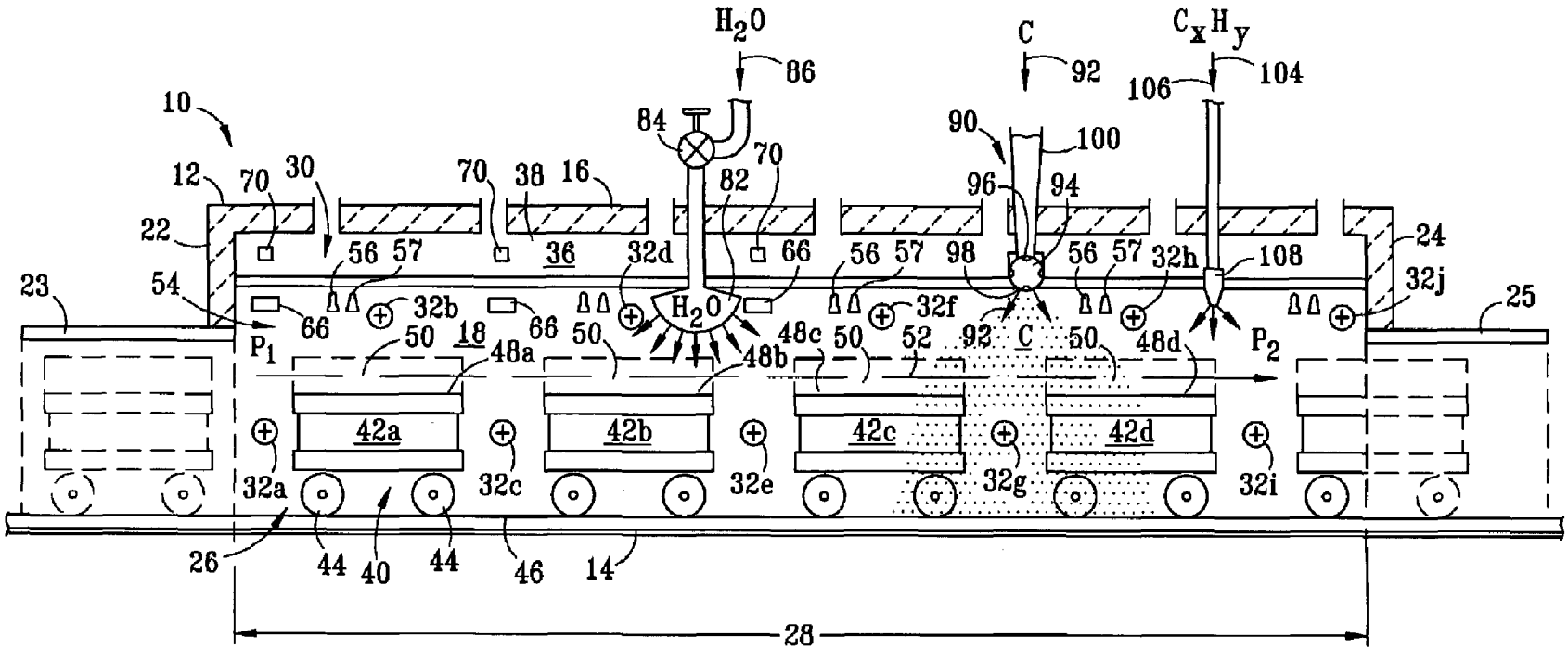
FIG. 1 is a schematic cut away side view of a tunnel oven according to one embodiment of the invention.
Figure 2:
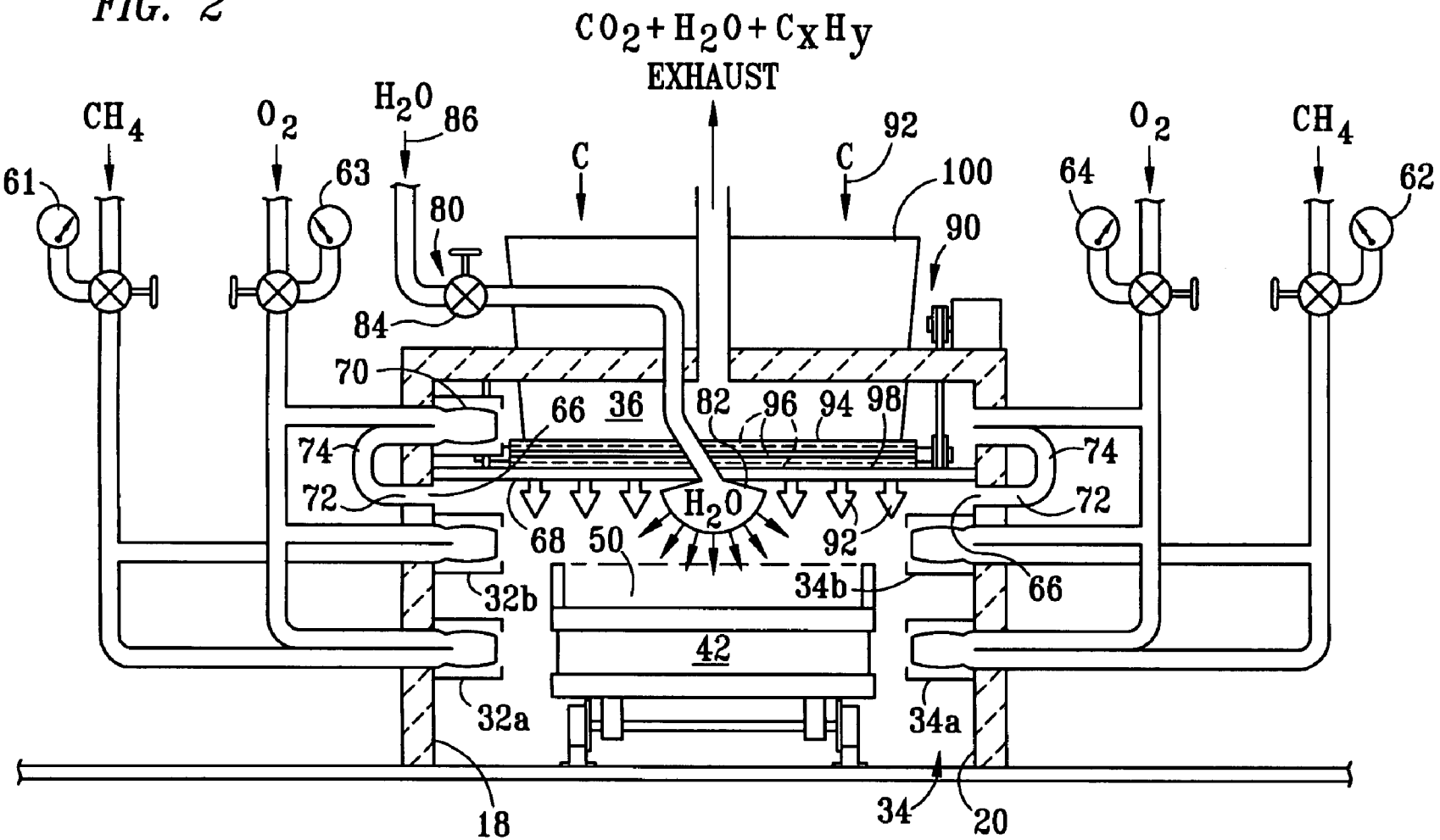
FIG. 2 is a schematic cut away end view of the tunnel oven of FIG. 1.

FIG. 1 shows a schematic cutaway side view of a tunnel oven 10 according to one embodiment of the invention. FIG. 2 shows a cutaway end view of the tunnel oven 10 shown in FIG. 1. An enclosure 12 has a bottom 14, a top 16 sidewalls 18 and 20 and (side wall 20 not shown in FIG. 1, see FIG. 2), and ends 22 and 24. A passage 26 extends along the length 28 of the enclosure 12 of the tunnel oven 10. A heater system 30 is provided to heat the passage along its length 26. The heater system 30 may include a plurality of burners 32, for example burners 32*a–j*, along one side wall 18. It will be understood that the number of burners can vary depending upon the size of the tunnel and the size or heating capabilities of the burners so that the desired high temperatures are obtained in a commercially acceptable length of time. In one embodiment another set of a plurality of burners 34 may be provided along the opposing sidewall 20 and in alternating positions with the burners 32 to provide good heat distribution. (For clarity, only burners 34*a–b* are shown in FIG. 2). The heater system 30 may also include a combustion chamber 36 constructed in the roof 38 between the top 16 and the passage 26. The heater system 30 operates on a positive pressure basis such that a fuel, air, and exhaust gas mixture inside the passage 26 has a pressure greater than the outside atmospheric pressure so that it acts to exclude the introduction of air from outside the oven. Thus, introduction of air into the passage is reduced to an acceptably low amount while still permitting carbonaceous materials 50 to be introduced into the oven through an entrance end 22, moved through the oven passage 26, and moved out of the oven passage 26 from an exit end 24. The entrance 22 and exit 24 may be opened for insertion of the carbonaceous material and then closed for continuous, controlled atmosphere heating. For example, heat and atmosphere separating devices 23 and 25 are shown on either end 22 and 24 respectively, of the tunnel oven 10. The separating devices 23 and 25 are designed to temporarily move out of the path of the carbonaceous material to allow entry and exit to and from the tunnel oven passage 26 and to close or otherwise form a barrier to exchange of atmosphere while the carbonaceous materials are within the tunnel oven 10.

Those skilled in the art will understand from this disclosure that one example of separating devices 23 and 25 are known as vestibules. Vestibules are basically a chamber that has a front door and a back door. The back door is positioned adjacent to the tunnel oven entry end 22 and is effectively sealed to the oven. In operation the back door is closed, and the front door is opened to receive the carbonaceous materials while the back door remains closed. When the carbonaceous materials are within the vestibule, the front door is also closed and then the backdoor is opened to allow the carbonaceous materials to move through the back door and then into entrance end 22 and the tunnel oven passage 26. The reverse procedure is employed to let the carbonaceous materials exit the end 24 of the tunnel oven passage 26. A first door to the vestibule adjacent the oven is opened while the second door is closed. When the carbonaceous materials are within the vestibule, the first door is closed and the second door is opened to let the carbonaceous materials exit without loosing the atmosphere maintained in the tunnel oven.

Those skilled in the art will also understand from this disclosure that an alternative example the separating devices 23 and 25 might be a moving air curtains. Moving air curtains provide a plurality of aligned high velocity air jets that move air past the entrance end 22 and also past the exit end 24. The solid carbonaceous materials can pass through the air curtain; however the rapidly moving air creates a boundary layer barrier to the transfer of gaseous atmosphere. When the carbonaceous materials are in the tunnel oven the air curtain acts to separate the exterior atmosphere from the interior atmosphere in the tunnel oven.

A transport device 40 may be used to carry and transport the carbonaceous materials through the tunnel oven according to one embodiment of the invention. One example of a transport device includes a plurality of materials carrying carts 42*a–d* having temperature resistant metal wheels 44 guided along temperature resistant tracks 46. It will be understood that the number of carts 42 may be any number consistent with the size of the carts and of the tunnel oven such that the letter designations a–d are representative and are not intended to limit the number. The carts 42*a–d* may each movably support one of a plurality of container 48*a–d* for carrying carbonaceous materials 50. The containers 48*a–d* may be made of a high temperature resistant and relatively inert material such as refractory material so that the containers 48*a–d* do not oxidize or otherwise chemically react or interfere with the combustion of the fuel gasses and the heating of the carbonaceous materials 50. It will be understood by those skilled in the art based upon this disclosure that other high temperature transport devices might be constructed for transporting carbonaceous materials along the length 28 of the passage 26 through the enclosure tunnel oven 10. For example, and without limitation, a conveyor belt system with the requisite thermal and chemical resistance or a plurality of temperature resistant and chemically inert rollers might be used without departing from certain aspects of the invention.

In the embodiment depicted in FIG. 1 and FIG. 2 the burners 32*a–j* may be methane gas burners positioned above and below the path indicated by arrow 52, of the carbonaceous materials to be heated as they are moved through the passage 26. On the opposite side wall 20 methane burners 34*a–j* may be provided to facilitate uniform controlled heating and atmosphere control (for clarity only burners 34*a–b* are shown in FIG. 2). It will be understood that the number of burners 32 and 34 may be any number depending upon the size of the burners and heating requirements for the tunnel oven such that the letter designations 32*a–j* and 34*a–b* (34*c–j* not shown) are representative and are not intended to limit the number of burners 32 and 34. A temperature control mechanism 54, may include one or more temperature sensors 56 that are positioned along the passage 26, and where a plurality of sensors are used they may be usefully provided at a plurality of positions so that the temperature in the passage at the various positions may be separately sensed. One or more oxygen sensors 57 may also be usefully provided at one or more locations along the passage 26. The oxygen sensors 57 are used to monitor the atmosphere within the tunnel oven 10 and to facilitate controlling the atmosphere so that the carbonaceous materials may be heated to above its combustion temperature without oxidation of the carbonaceous materials. The heater mechanism 30 may be controlled according to the sensed temperature to provide desired temperatures along the passage 26.

In one embodiment of the invention a positive pressure P1 is provided within the passage 26 and adjacent to the entrance end 22. The pressure P1 is adjusted using the pressure and volume of methane gas, adjusted at regulators 61 and 62, and the volume of air (the source of oxygen, $O_2$), and adjusted at regulators 63 and 64. The oxygen sensors 57 are used to monitor the oxygen level within the tunnel oven and to increase the oxygen proportionately to the methane gas when additional methane gas fuel is added to raise the temperature, or to reduce the oxygen when the methane gas fuel is reduced to lower the temperature. The proper pressure and mixture is controlled so that the positive pressure is maintained. A gradient of pressure is desirably provided along the length of the passage 26 with higher pressure P1 at the entrance end 22 and lower pressure P2 at the exit end 24, such that both P1 and P2 are higher that the external atmospheric pressure. For example, the individual burners may each have separate regulators 61, 62, 63, and 64 corresponding to each burner 32*a–j* and 34*a–j*, respectively. Each burner 32*a–e* and 34*a–e* may be adjusted to progressively decrease from the entrance burners 32*a* and 34*a* to burners 32*j* and 34*j* adjacent the exit end 24. Alternatively several regulators may control separate zone comprised of several burners. Thus, for example the burners 32*a* and 32*b* may be adjusted at one pressure and volume setting to obtain the desired heating rate and the desired pressure P1 and a lower pressure volume of methane gas and air injected in a zone with the burners 32*i* and 32*j* so that a pressure P2 is obtained that is greater than the atmospheric pressure and slightly lower than the positive entrance pressure P1.

The temperature is controlled also by the amount of heat provided by combustion of the fuel with the $O_2$ in the air. To avoid the carbonaceous material oxidizing in the air an excess amount of methane fuel is provided. Thus, direct convection heating of the carbonaceous material 50 to temperatures above the combustion temperature of the carbonaceous material can be accomplished without oxidizing the surface of the carbonaceous material 50. The heat generated is therefore controlled by regulating the amount of air ($O_2$) injected into the burners. The oxygen sensors are used to monitor the atmosphere quality so that the oxygen level is lean and an excess amount of fuel or combustible hydrocarbon evolved from the heated carbonaceous materials is present for combustion. Thus, the temperature and atmosphere are controlled according to the temperature sensed at sensors 56 and the oxygen sensed by oxygen sensors 57 along the inside of the tunnel oven adjacent to the burners or in the zone or area surrounding the burner that is thus adjusted.

Figure 3:
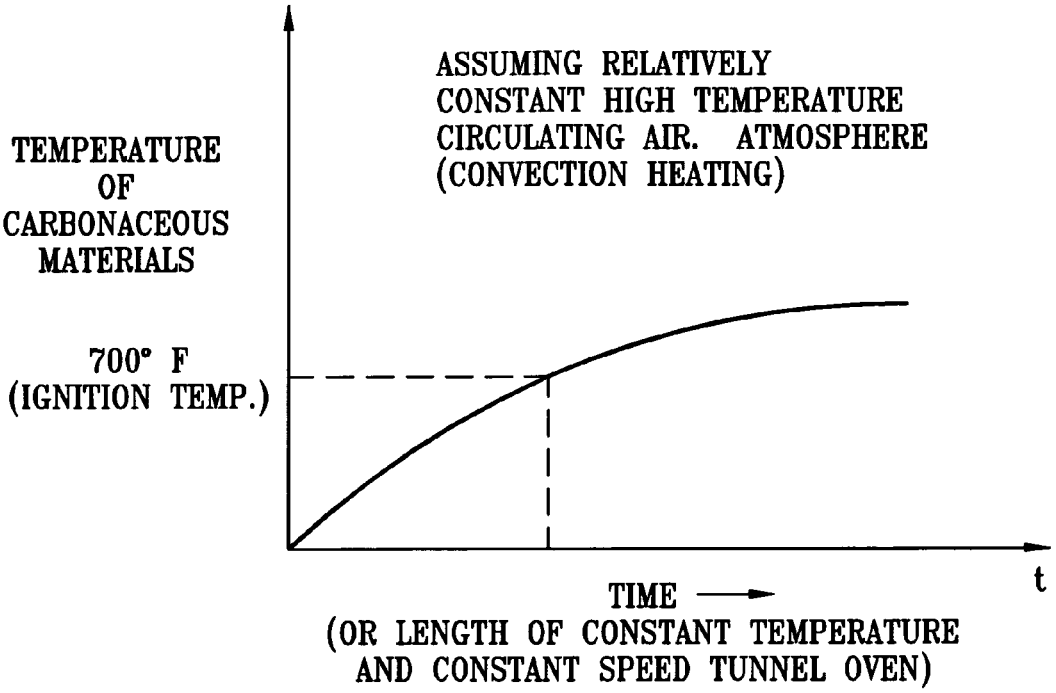
FIG. 3 is a graph of temperature versus time or length of travel at a constant rate and in a tunnel oven.
Figure 4:
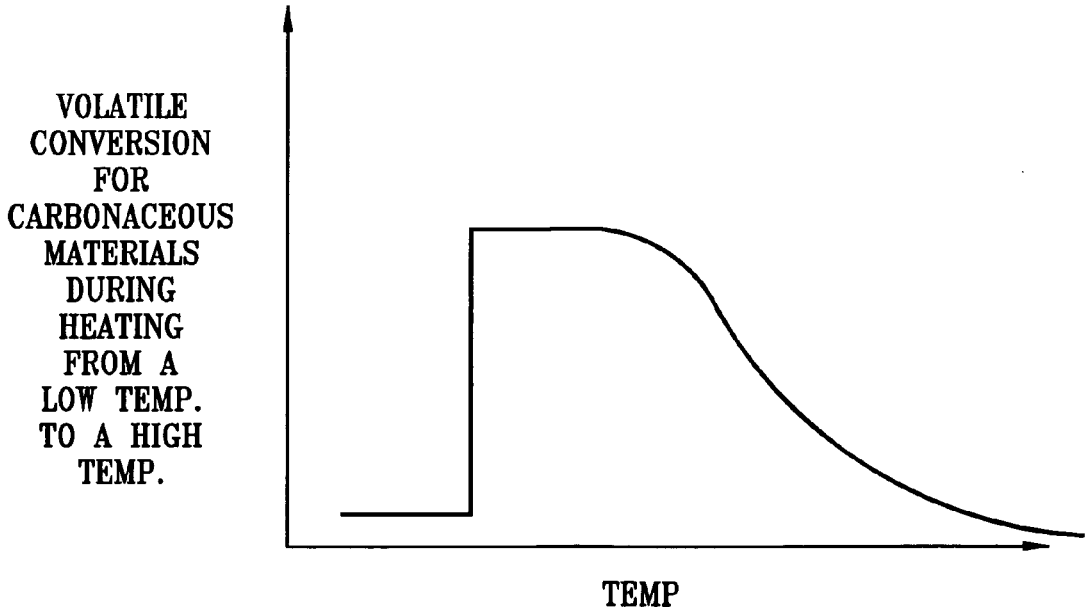
FIG. 4 is a graph of a volatile gas removal versus temperature of a carbonaceous material heated from a low temperature to progressively higher temperatures in a tunnel oven.

With reference to FIG. 3 it will be understood that when the carbonaceous material is subjected to circulating burning gases from the burners 32 and 34, and assuming a constant high temperature atmosphere within the passage 26, the temperature of the carbonaceous material will raise by direct convection heat transfer. The graph depicts the raise in temperature a function of time. Also for constantly moving carbonaceous materials, the time is also related to the length of the passage that is traverse. The methane gas will burn at a temperature that is substantially above the ignition temperature of the carbonaceous materials. For example above the ignition temperature of about 700° C. Referring to FIG. 4, it will also be understood that when the carbonaceous materials reach a temperature at which volatiles are given off, a significant portion will be given off fairly rapidly over a range of increasing temperatures and then as the temperatures increase further the amount of evolved volatiles will decrease until all the volatiles have been released. The range and specific temperatures will depend upon the composition of the carbonaceous materials. Generally a portion of the volatiles are likely to be light combustible hydrocarbons and others may be larger hydrocarbon chains. The light volatiles may provide the burning energy in the passage 26 and the amount of methane fuel may be reduced accordingly. Any excess unburned volatiles and unburned methane gas may be extracted at extraction ports 66 and then re-circulated through conveyance tubes 72 into a burner 70 positioned in the roof burning chamber 70.

In the event the volatiles or portions of the volatiles released from the carbonaceous materials are long chain hydrocarbons prior to heating they may be expected to break down into lighter shorter chain hydrocarbons at a sufficiently high temperature above the ignition temperature of other portions of the carbonaceous materials. The long chain volatiles might not ignite while in the tunnel oven passage. Such chains may be further cracked in a cracking zone 74 positioned along the conveyance tubes 72 so that the hydrocarbons can be efficiently burned in the roof combustion chamber 36. The heat generated in the roof is conveyed to the tunnel oven passage and to the materials transported by conduction through the ceiling 68 and by radiant energy heat transfer from the ceiling 68 into the passage 26 and directly to the carbonaceous material 50. Thus, the mixture of air to fuel in the roof combustion chamber 36 can be adjusted to be stochiometrically balanced or to provide an excess proportion of oxygen without the $O_2$ combining with the carbonaceous materials 50 transported through the oven 10.

The temperature can be further controlled by a cooler mechanism 80 that may comprise a water spray nozzle 82 adjustably supplied with water through a valve 84 in fluid communication with a water supply 86. It will be understood that the number and placement or positioning of the cooler mechanism 80 is not intended to be limited by one water cooler mechanism 80 and spray nozzle 82 depicted as a schematic example in FIGS. 1 and 2. More than one cooler mechanism 80 and multiple alternative placements and positioning may also be useful as will be understood by those skilled in the art based upon the present disclosure.

In one embodiment the atmosphere is further controlled to avoid oxidation of the solid carbonaceous material 50 by injecting carbon dusts 92. A carbon dust injection mechanism 90 may be used that includes a carbon dust source 84. The dust injecting mechanism is usefully designed to introduce the carbon dust without introducing significant additional air and without allowing too much of the internal atmosphere to escape from the tunnel oven. In one embodiment a dust injector 90 may include a distributor roller 94 having a plurality of troughs 96 cut into the surface. The roller is rotated in a seal 98 such that carbon dust 92 contained in a hopper 100 is distributed from the hopper into the tunnel oven 10 as the distributor roller 94 is rotated. Thus even when all of the excess hydrocarbon fuel is depleted by combustion in the passage and/or in the combustion chamber 70, the dust particles have a significantly larger percentage of surface area and form the preferred oxidation sites for any remaining oxygen. The solid carbonaceous material 50 is therefore relatively protected against oxidation reaction in the area or zone where the carbon dust is injected. The carbon dust is the same material as the carbonaceous material 50 so that its presence does not adversely affect the heating processes occurring in the material 50. It will be understood that the number and placement or positioning of the carbon dust injection mechanism 90 is not intended to be limited by one carbon dust injection mechanism 92 depicted as a schematic example in FIGS. 1 and 2. More than one carbon dust injection mechanism 90 and multiple alternative placements and positioning may also be useful as will be understood by those skilled in the art based upon the present disclosure. The relative positioning of the cooler mechanisms 80 and the carbon dust injection mechanisms 90 may also be varied according to the desired heating process, temperatures and atmospheric control desired for the relative heating and relative cooling of carbonaceous materials within the tunnel oven.

In another embodiment of the invention the atmosphere may be controlled to provide preferred reaction with injected hydrocarbon gas 104 or vaporized hydrocarbon oil 106 as for example through an injector 108. As with the carbon dusts 92, The combustion components in the hydrocarbon gas 106 or vaporized oil 106 will be more readily combusted than the solid carbonaceous material 50 so that the carbonaceous material 50 will be protected against oxidation.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A tunnel oven for heating transported carbonaceous materials comprising:

an enclosure having a passage with a length;

a transport device for moving solid carbonaceous materials through and along the length of the passage;

a heater operably connected to the enclosure to heat the carbonaceous materials as the carbonaceous materials are moved along the length of the passage, wherein the heater comprises a convection heater for indirectly heating the atmosphere in the passage so that the carbonaceous materials are surrounded by heated atmosphere and thereby heated on all exposed surfaces and a radiant heater for radiantly heating the carbonaceous materials transported through the passage;

a temperature controller operably coupled to the heater to provide one or more selected temperatures along the length of the passage; and an atmosphere controller to control the atmosphere along the length of the passage.

2. The tunnel oven of claim 1 wherein the temperature controller comprises an adjustable thermostat for measuring the temperature in the passage, the thermostat operably coupled to the heater for increasing or decreasing the amount of heating to provide an adjusted temperature.

3. The tunnel oven of claim 1 further comprising a cooler and wherein the temperature controller comprises an adjustable thermostat for measuring the temperature in the passage, the thermostat operably coupled to the heater and to the cooler for increasing or decreasing the amount of heating or cooling to provide an adjusted temperature.

4. The tunnel oven of claim 1 further comprising a plurality of heaters and at least one cooler and wherein the temperature controller comprises a plurality of adjustable thermostats for measuring the temperature at a plurality of positions along the length of the passage, the thermostats operably coupled to the heaters and the at least one cooler for increasing or decreasing the amount of heating or cooling to provide a plurality of adjusted temperatures at the plurality of positions along the length of the passage.

5. The tunnel oven of claim 1 wherein the enclosure comprises top, bottom sides and ends wherein the ends comprise selectably openable vestibules for permitting entrance and exit of materials to be transported there through.

6. The tunnel oven of claim 1 wherein the transport device comprises a transport device selected from the group of transport carts rolling on tracks, high temperature conveyor belt, and conveyor rollers.

7. The tunnel oven of claim 1 wherein the heater comprises a plurality of gas burners positioned along the passage and directed above and below the path of the materials transported therethrough for indirectly heating the atmosphere in the passage so that the materials are surrounded by heated atmosphere and thereby heated on all exposed surfaces.

8. A tunnel oven for heating transported carbonaceous materials comprising:

an enclosure having a passage with a length;

a transport device for moving solid carbonaceous materials through and along the length of the passage;

a heater operably connected to the enclosure to heat the carbonaceous materials as the carbonaceous materials are moved along the length of the passage;

a temperature controller operably coupled to the heater to provide one or more selected temperatures along the length of the passage; and further comprising a plurality of heaters and at least one cooler and wherein the temperature controller comprises a plurality of adjustable thermostats for measuring the temperature at a plurality of positions along the length of the passage, the thermostats operably coupled to the heaters and the at least one cooler for increasing or decreasing the amount of heating or cooling to provide a plurality of adjusted temperatures at the plurality of positions along the length of the passage; and wherein the at least one cooler comprises at least one water spray injection mechanism placed in at least one position along the length of the passage at which the temperature of the gaseous atmosphere is cooled to below the ignition point of the carbonaceous materials such that the surface of the carbonaceous materials is protected from oxidation combustion in the at least one position cooled by the water spray.

9. The tunnel oven of claim 8 wherein the enclosure comprises top, bottom sides and ends wherein the ends comprise selectably openable vestibules for permitting entrance and exit of materials to be transported there through.

10. The tunnel oven of claim 8 wherein the transport device comprises a transport device selected from the group of transport carts rolling on tracks, high temperature conveyor belt, and conveyor rollers.

11. The tunnel oven of claim 8 wherein the heater comprises a convection heater for indirectly heating the atmosphere in the passage so that the materials are surrounded by heated atmosphere and thereby heated on all exposed surfaces.

12. The tunnel oven of claim 8 wherein the heater comprises a plurality of gas burners positioned along the passage and directed above and below the path of the materials transported therethrough for indirectly heating the atmosphere in the passage so that the materials are surrounded by heated atmosphere and thereby heated on all exposed surfaces.

13. A tunnel oven for heating transported carbonaceous materials comprising:

an enclosure having a passage with a length;

a transport device for moving solid carbonaceous materials through and along the length of the passage;

a heater operably connected to the enclosure to heat the carbonaceous materials as the carbonaceous materials are moved along the length of the passage;

a temperature controller operably coupled to the heater to provide one or more selected temperatures along the length of the passage;

an atmosphere controller to control the atmosphere along the length of the passage;

wherein the atmosphere controller comprises a gaseous hydrocarbon fuel injector wherein the injected hydrocarbon gas fuel is in excess of the oxygen available for combustion so that the carbonaceous materials are not oxidized upon heating.

14. The tunnel oven of claim 13 wherein the temperature controller comprises an adjustable thermostat for measuring the temperature in the passage, the thermostat operably coupled to the heater for increasing or decreasing the amount of heating to provide an adjusted temperature.

15. The tunnel oven of claim 13 further comprising a cooler and wherein the temperature controller comprises an adjustable thermostat for measuring the temperature in the passage, the thermostat operably coupled to the heater and to the cooler for increasing or decreasing the amount of heating or cooling to provide an adjusted temperature.

16. The tunnel oven of claim 13 further comprising a plurality of heaters and at least one cooler and wherein the temperature controller comprises a plurality of adjustable thermostats for measuring the temperature at a plurality of positions along the length of the passage, the thermostats operably coupled to the heaters and the at least one cooler for increasing or decreasing the amount of heating or cooling to provide a plurality of adjusted temperatures at the plurality of positions along the length of the passage.

17. The tunnel oven of claim 13 wherein the enclosure comprises top, bottom sides and ends wherein the ends comprise selectably openable vestibules for permitting entrance and exit of materials to be transported there through.

18. The tunnel oven of claim 13 wherein the transport device comprises a transport device selected from the group of transport carts rolling on tracks, high temperature conveyor belt, and conveyor rollers.

19. The tunnel oven of claim 13 wherein the heater comprises a convection heater for indirectly heating the atmosphere in the passage so that the materials are surrounded by heated atmosphere and thereby heated on all exposed surfaces.

20. The tunnel oven of claim 13 wherein the heater comprises a plurality of gas burners positioned along the passage and directed above and below the path of the materials transported therethrough for indirectly heating the atmosphere in the passage so that the materials are surrounded by heated atmosphere and thereby heated on all exposed surfaces.

21. A tunnel oven for heating transported carbonaceous materials comprising:

an enclosure having a passage with a length;

a transport device for moving solid carbonaceous materials through and along the length of the passage;

a heater operably connected to the enclosure to heat the carbonaceous materials as the carbonaceous materials are moved along the length of the passage;

a temperature controller operably coupled to the heater to provide one or more selected temperatures along the length of the passage;

an atmosphere controller to control the atmosphere along the length of the passage;

wherein the atmosphere controller comprises a carbon dust injection mechanism by which carbon dust is injected into the passage at a position along the length, the carbon dust having a minimum dimension substantially less than the minimum dimension of the carbonaceous materials transported through the tunnel oven such that any oxygen available for oxidation will combine with the carbon dust with much higher probability than the oxygen will combine with the solid carbonaceous materials transported through the tunnel oven thereby protecting the surface of the carbonaceous materials from oxidation.

22. The tunnel oven of claim 21 wherein the temperature controller comprises an adjustable thermostat for measuring the temperature in the passage, the thermostat operably coupled to the heater for increasing or decreasing the amount of heating to provide an adjusted temperature.

23. The tunnel oven of claim 21 further comprising a cooler and wherein the temperature controller comprises an adjustable thermostat for measuring the temperature in the passage, the thermostat operably coupled to the heater and to the cooler for increasing or decreasing the amount of heating or cooling to provide an adjusted temperature.

24. The tunnel oven of claim 21 further comprising a plurality of heaters and at least one cooler and wherein the temperature controller comprises a plurality of adjustable thermostats for measuring the temperature at a plurality of positions along the length of the passage, the thermostats operably coupled to the heaters and the at least one cooler for increasing or decreasing the amount of heating or cooling to provide a plurality of adjusted temperatures at the plurality of positions along the length of the passage.

25. The tunnel oven of claim 21 wherein the enclosure comprises top, bottom sides and ends wherein the ends comprise selectably openable vestibules for permitting entrance and exit of materials to be transported there through.

26. The tunnel oven of claim 21 wherein the transport device comprises a transport device selected from the group of transport carts rolling on tracks, high temperature conveyor belt, and conveyor rollers.

27. The tunnel oven of claim 21 wherein the heater comprises a convection heater for indirectly heating the atmosphere in the passage so that the materials are surrounded by heated atmosphere and thereby heated on all exposed surfaces.

28. The tunnel oven of claim 21 wherein the heater comprises a plurality of gas burners positioned along the passage and directed above and below the path of the materials transported therethrough for indirectly heating the atmosphere in the passage so that the materials are surrounded by heated atmosphere and thereby heated on all exposed surfaces.

* * * * *